US008863997B2

(12) United States Patent
Hickey

(10) Patent No.: US 8,863,997 B2
(45) Date of Patent: Oct. 21, 2014

(54) FUEL DELIVERY NOZZLE AND AIR VENT AND PORTABLE CONTAINER HAVING SAME

(71) Applicant: Steven Hickey, Ashland, MA (US)

(72) Inventor: James R. Hickey, Ashland, MA (US)

( * ) Notice: Subject to any disclaimer, the term of this patent is extended or adjusted under 35 U.S.C. 154(b) by 0 days.

(21) Appl. No.: 14/195,264

(22) Filed: Mar. 3, 2014

(65) Prior Publication Data

US 2014/0190988 A1 Jul. 10, 2014

Related U.S. Application Data

(63) Continuation-in-part of application No. 13/114,302, filed on May 24, 2011, now Pat. No. 8,662,359.

(60) Provisional application No. 61/397,863, filed on Jun. 18, 2010.

(51) Int. Cl.
*B67D 3/00* (2006.01)
*B65D 25/46* (2006.01)

(52) U.S. Cl.
CPC ..... *B65D 25/46* (2013.01)
USPC ..... 222/484

(58) Field of Classification Search
USPC ..... 222/533, 536, 537, 556, 481.5, 548, 222/549, 484, 478, 534, 563, 558, 559, 560, 222/561, 482, 483, 485, 545, 470; 220/203.6, 220, 705, 709, 745
See application file for complete search history.

(56) References Cited

U.S. PATENT DOCUMENTS

| | | | | |
|---|---|---|---|---|
| 2,839,227 | A * | 6/1958 | Wilson et al. | 222/484 |
| 2,979,238 | A * | 4/1961 | Bramming | 222/484 |
| 4,946,079 | A * | 8/1990 | Campbell | 222/484 |
| 5,383,603 | A * | 1/1995 | Englhard et al. | 239/314 |
| 6,793,104 | B2 * | 9/2004 | Kao | 222/481.5 |
| 8,573,452 | B2 * | 11/2013 | Whitcomb et al. | 222/484 |
| 2004/0094580 | A1 * | 5/2004 | Patz | 222/484 |

* cited by examiner

*Primary Examiner* — Paul R Durand
*Assistant Examiner* — Donnell Long
(74) *Attorney, Agent, or Firm* — Chapin IP Law, LLC

(57) ABSTRACT

Featured is a delivery nozzle/vent assembly for a portable container including a first section, a second section movable coupled to the first section, a passageway alignment assembly and a valve assembly. The alignment assembly is configured and arranged to align liquid and air lines/passages of the first and second sections when the nozzle is moved to a given position. The valve assembly includes an actuation mechanism that selectively fluidly couples/decouples the aligned liquid and air lines/passages in the first and second sections. When these passages are so fluidly coupled, liquid can flow from the portable container and delivered to a targeted receptacle and air can flow into the container as a volume replacement for the departing liquid. Also featured are a portable container with such a nozzle/vent assembly and methods related thereto. The liquid can be a liquid organic compound such as gasoline, kerosene and diesel.

28 Claims, 11 Drawing Sheets

FIG. 8
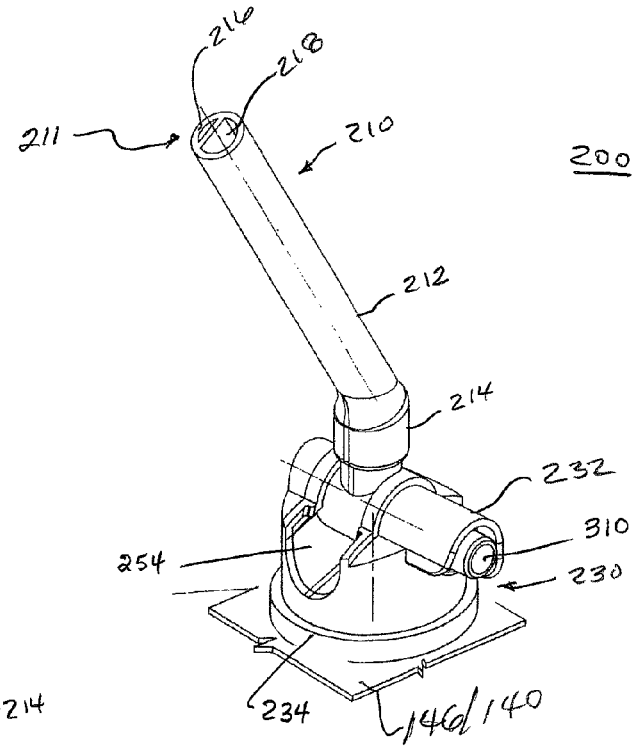
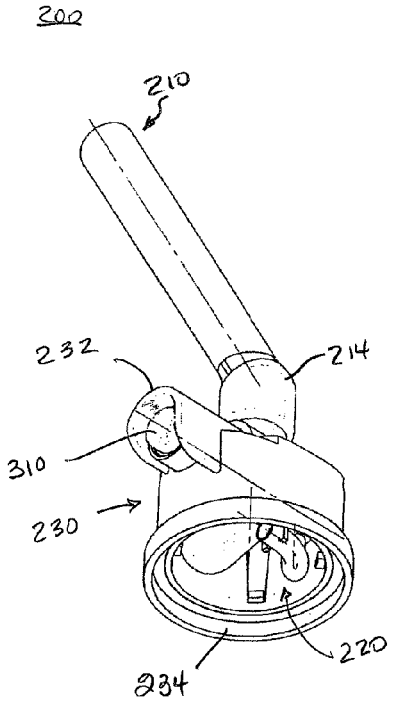
FIG. 9A

FIG. 9B
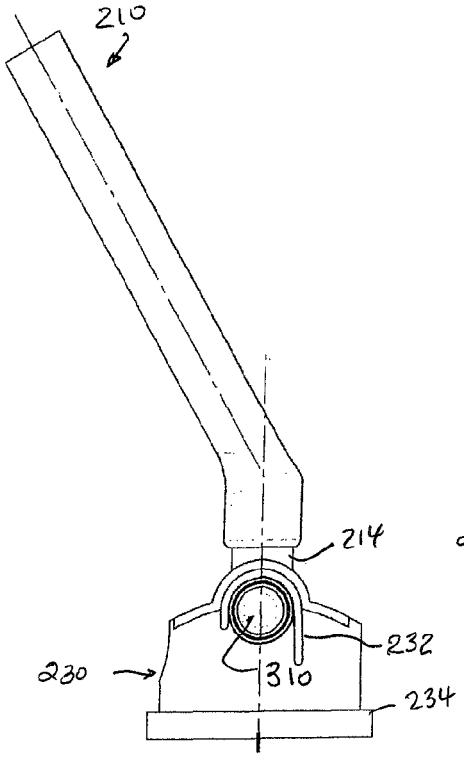
FIG. 9C
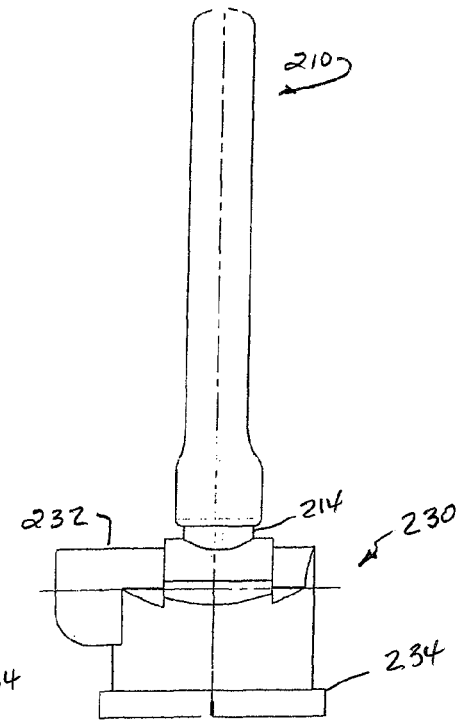
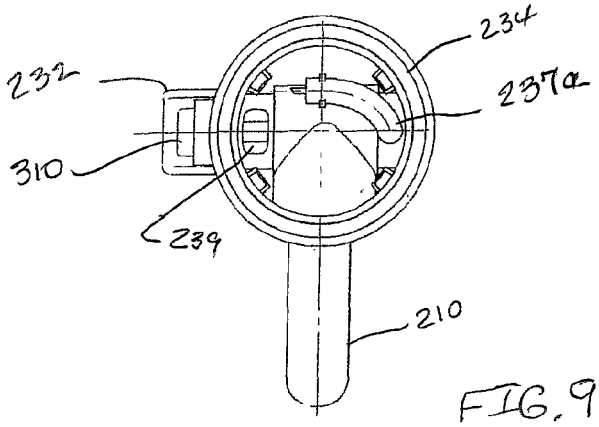
FIG. 9D 216
218
210

212
230
232
254
234
233
214
233
332a
322a
300
231a
237
235
330
310
236
254a
320
230
237a
239
231b
146
140

FUEL DELIVERY NOZZLE AND AIR VENT AND PORTABLE CONTAINER HAVING SAME

This application is a continuation-in-part of U.S. application Ser. No. 13/114,302, filed May 24, 2011 (now allowed), which application claims the benefit of U.S. Provisional Application Ser. No. 61/397,863 filed Jun. 18, 2010, the entire teaching, disclosure and contents of each are herein incorporated by reference in their entirety.

FIELD OF INVENTION

The present invention generally relates to portable containers such as a portable fuel container utilized for transporting gasoline, diesel or kerosene, more particularly the present invention features a delivery nozzle and fuel vent for such portable containers and more specifically to a fuel container having such a delivery nozzle and fuel vent.

BACKGROUND OF THE INVENTION

There are a number of tools, devices, garden or recreational vehicles, or apparatus that are fueled by gasoline, diesel or kerosene and require periodic replenishment of the fuel to keep the tool, device, vehicle or apparatus running. For example, fuel needs to be added to the fuel tank of an electric motor generator so that the motor generator can to continue to provide electricity. These tools, devices and apparatus are usually fueled/refueled by means of a fuel container. In addition, vehicles such as automobiles and trucks typically use gasoline or diesel as a fuel for operating the vehicle. When the vehicle runs out of fuel, fuel maybe delivered by an emergency vehicle (e.g., tow truck) to the vehicle fuel tank using such a portable fuel container.

Initially such portable fuel containers were derived from the old metal "Jerry Cans" that were used by military in World War II. The fuel containers were initially constructed of metal, however, after the advent of plastics, the fuel containers or fuel cans were made from a plastic, such as polyethylene. These fuel containers also were constructed to include a fuel delivery nozzle through which fuel was dispensed and a venting nozzle. The fuel delivery nozzle also was generally designed to be removable so the container could be filled with the fuel.

The vent nozzle was provided so that air was admitted into the fuel container as fuel was being delivered or poured from the container. When fuel was not being delivered such as when the fuel container was be used to store the fuel, the air vent nozzle and fuel delivery nozzle were supposed to be closed off (e.g., to prevent liquid fuel and/or fuel vapor from escaping from the fuel container). Practically speaking, however, for a number of reasons the nozzles were not completely closed or not closed at all thereby allowing liquid fuel and/or fuel vapor (e.g., VOCs) to escape from the container (e.g., container got knocked over and the user did not cap the fuel delivery nozzle and/or the vent nozzle after use). It has been determined that because of the large number of such containers that have been sold or in use, large quantities of VOCs were escaping into the atmosphere either due to evaporation or vapor from the fuel container or the evaporation of any spillage of liquid fuel and thereby causing unacceptable environmental issues.

Thus, efforts began and continue to be undertaken to prevent or at least minimize the release of such VOCs into the atmosphere. For example, the California Air Research Bureau formulated specifications for portable fuel containers to assure that VOCs are not being emitted into the atmosphere. Also, ASTM International (or its predecessor) developed and published standards for the manufacture and design of such portable fuel containers and the nozzles for use with such containers also to ostensibly prevent the emission of VOCs into the atmosphere. These standards and specifications were developed so as to minimize, to the extent practicable, reliance on a person's actions in preventing the release of VOCs into the atmosphere.

As a result of such standards and other actions taken by states and federal government, such portable fuel containers are not usually configured with a separate vent nozzle. Rather the nozzle assembly provided with the fuel container (or being sold separately), is configured so that the user must take some action to allow fuel to be poured from the container and until such action is taken fuel cannot be poured. Also when the user takes such action, the air pathway that admits air into the container is opened, however, until such action is taken the pathway remains closed.

As is known to those skilled in the art, the fuel container must have an air vent to allow air to enter the container while the fuel is being poured to replace the volume of fluid as it exits the container. This prevents a vacuum or vacuum lock-up condition being created inside the container during pouring or dispensing of the fuel, which would prevent the fuel from exiting, or from easily exiting, the container.

Such fuel storage containers also are now typically color coded to indicate the kind of fuel being stored in the container (e.g., red for gasoline, blue for kerosene and yellow for diesel). In this way, a user should not accidentally pour the wrong kind of fuel (e.g., gasoline into diesel) into the fuel tank of the device, apparatus or vehicle. For example, gasoline has a lower ignition point than diesel, so if these fuels get intermixed they can lead to adverse even dangerous problems with the operation of the engine.

One conventional fuel container and/or nozzle assembly presently being sold is/are configured so that the nozzle assembly is secured to a fill/delivery nozzle of the fuel container. In contrast to prior fuel containers, this container does not have a dedicated vent nozzle. Rather the nozzle assembly, which is operably coupled to the container and container interior, is configured to be self-venting so that the nozzle assembly delivers the fuel and also allows air to flow into the container while fuel is being poured. When fuel is not being poured such as when the fuel is being stored, the nozzle assembly also is configured so the liquid or vapor fuel should not escape from the container.

As indicated herein, such a self-venting nozzle assembly requires some positive action by the user to allow the fuel to be poured and the air to be admitted into the container otherwise the nozzle assembly seals off the container. Such a self-venting nozzle assembly is typically configured so it typically includes a handle and a laterally moving switch that is disposed in the handle and where the switch moves between a STORE position (i.e., closed position) and a POUR position (i.e., open position). When this lateral switch is in the POUR position, the user also is typically required to push down on the handle. When both the switch is in this POUR position and the handle is in the down position, the nozzle assembly is then arranged so fuel can be poured and so air can be admitted into the container. This process continues as long as the switch remains in the POUR position and the handle remains in the down position. If the downward force is removed or is reduced below a set value, the nozzle assembly is configured to automatically cut off the flow of gas and air.

With such a fuel container, the user also must manipulate the fuel container (e.g., using handholds or handles provided with the container) so the open end of the nozzle of the nozzle assembly is appropriately positioned with respect to a fill nozzle for the fuel tank of the device, apparatus or vehicle to which fuel is to be delivered. While such manipulating can occur after or before the user performs the above described process to open the fuel and vent air flow paths, it commonly occurs before the fuel container is being manipulated. In other words, the nozzle assembly for such fuel containers is designed, configured and arranged so the assembly effectively seals the fuel container unless fuel is to be and being dispensed/poured.

There is another self-venting nozzle assembly that has been sold, usually with small fuel containers. This self-venting assembly is configured so that the nozzle includes a feature or artifact that is proximal the open end of the nozzle, which feature is designed to mechanically engage a portion of the fill nozzle of the fuel tank to which fuel is to be delivered. After so engaging the fill nozzle, the user applies a force along the long axis of the nozzle (e.g., pushes down on the fuel container) which causes the nozzle to move in a direction along the long axis and thereby allow fuel and air to flow. When this force is removed or falls below a preset value, the nozzle is supposed to returns to its STORE position and the flow of fuel and air is cut off. Needless to say, this particular design of the nozzle assembly only works when the nozzle feature can mechanically engage a fill nozzle or tube of the fuel tank.

The nozzle for such nozzle assemblies, however, is typically short so that it generally does not, or does not appreciably, extend beyond the fuel container when it is sitting on the floor or a flat surface. This is likely done to reduce the potential for someone colliding with the nozzle and knocking the fuel container over. Thus, in particular situations, positioning of the nozzle proximal the fuel tank fill nozzle for safe delivery of the fuel can be very difficult to impossible, particularly when using large (e.g., 5 gallon fuel containers). Consequently, in certain situatkions or applications the user must use another device (e.g., funnel) or a nozzle extender (if available) to deliver the fuel.

The use of such another device, however, can increase the potential for spilling the liquid fuel. For example, as both hands of the user are being used or occupied with manipulating/holding the fuel container and simultaneously continuously depressing the handle during pouring, the user cannot hold the "another device" while pouring the fuel. As the "another device" also can occlude the user's view of the fill nozzle, there also is the potential for fuel spillage in certain situations resulting from overfilling the fuel tank. For example, one might pour more fuel into the "another device" than the fuel tank can hold.

In addition, when a motor vehicle includes a tamperproof or anti-tamper fill nozzle, the manufacturer typically includes a device (e.g., specially designed funnel) so it can be used to open the fill nozzle for fuel delivery. This is because, the user as well as the delivery nozzle of nozzle assembly may not be able to generate sufficient force (e.g., longitudinal and radial force) to open the anti-tamper mechanism so fuel can be delivered. Again, this creates the potential for fuel spillage, particularly when using large fuel containers.

Thus, it is desirable to provide new and improved devices (e.g., nozzle assembly and/or portable fuel container) and methods related thereto. It would be particularly desirable to provide such a device and method that would provide a user activated mechanism (a redundant mechanism) to control the flow of fuel and vent air. Further, it would be desirable to provide such a mechanism in combination with a pivoting or rotating nozzle, thus providing two independent mechanisms controlling flow of liquid/fuel and vent air. It also would be desirable to provide such a device that allows the delivery nozzle to have a more appropriate length for the delivery of fuel without the need for other devices to deliver the fuel and thus minimize spillage as compared to prior art devices. Such fuel delivery devices preferably would be simple in construction and would not require highly skilled users to utilize the device.

SUMMARY OF THE INVENTION

The present invention generally features a delivery nozzle and air vent assembly for a portable container as well as a portable container with such a nozzle/vent assembly and methods related thereto. In its broadest aspects, such a delivery nozzle and air vent assembly includes a first section, a second section movable coupled to the first section, a passageway alignment assembly and a valve assembly. The alignment assembly is configured and arranged so as to align liquid and air lines/passages respectively of the first and second sections when a nozzle of the second section is moved to a given position. When the second section nozzle is move to another position, the liquid and air lines/passages respectively of the first and second sections are not aligned. It should be recognized that the liquid can be any of a number of liquids as are known in the art and more particularly, the liquids is a fuel or liquid organic compound such as gasoline, kerosene and diesel.

The valve assembly includes an actuation mechanism that selectively fluidly couples/decouples the liquid and air lines/passages in the first and second sections in particular when these liquid/air lines/passages are aligned. When these passages are so fluidly coupled, liquid can flow from the portable container and be delivered to a targeted receptacle and air can flow into the container such as from the atmosphere as a volume replacement for the liquid exiting the container. When the actuation mechanism is arranged so as to fluidly decouple the aligned liquid and air lines/passages in the first and second sections, liquid cannot flow from the container nor can air flow into the container.

In more particular embodiments, the alignment assembly further includes a sealing mechanism that seals the liquid and air lines/passages of the first and second sections so that liquid and air cannot flow when the liquid and air lines/passages in the first and second sections are not aligned. Thus, when the second section nozzle is moved into the "another" position, the liquid and air lines/passages respectively of the first and second sections are not aligned and also do not allow liquid and air to flow even if the actuation mechanism was otherwise arranged so to allow liquid and air to flow.

According to one aspect of the present invention there is featured a delivery nozzle and vent assembly for a portable container containing a liquid organic compound or fuel such as gasoline, kerosene or diesel. The portably container includes a fill/delivery nozzle and an interior volume. The delivery nozzle and vent assembly includes a first section, a second section, a passageway alignment assembly and a valve assembly. The first section is operably and fluidly coupled to the fill/delivery nozzle and the interior volume of the portable container. The first section also includes a liquid or fuel line through which liquid/fuel from the container flows and a vent airline through which air flows to the interior volume. The second section is movably coupled to the first section. The second section also includes a liquid or fuel delivery passage through which liquid/fuel flows from the first section and an air vent passage through which air flows to the first section. In more particular embodiments, the second section includes a nozzle that is movable with respect to the first section and which includes the liquid or fuel delivery passage through which liquid/fuel flows from the first section and an air vent passage through which air flows to the first section.

The passageway alignment assembly is disposed in the first and second sections and is configured so as to align the first section liquid/fuel line and the second section liquid/fuel delivery passage and to align the vent airline and the second section vent passage responsive to movement of the second section (i.e., nozzle) with respect to the first section. In more particular embodiments, when the second section is moved so as to be in one position with respect to the first section (e.g., POUR position), the first section liquid/fuel line and the second section liquid/fuel delivery passage are arranged and the vent airline and the second section vent passage are arranged so as to be aligned. In addition, when the second section (nozzle) is moved so as to be in another position with respect to the first section (e.g., STORE position), the first section liquid/fuel line and the second section liquid/fuel delivery passage and the vent airline and the second section vent passage are not aligned.

The valve assembly is configured so as to include a longitudinal valve member that has a first valve portion and a second valve portion, and an actuation member operably coupled to the longitudinal valve member. Further, the valve assembly is configured and arranged so that the first valve portion and second valve portion are selectively opened and closed responsive to movement of the actuation member.

The passageway alignment assembly and the valve assembly cooperate so that when (a) the first section liquid/fuel line and the second section delivery passage and the vent airline and the second section vent passage are aligned with respect to each other by the passageway alignment assembly and (b) the actuation member is moved such that the first and second valve portions are in the open position, the first section liquid/fuel line and the second section delivery passage are fluidly coupled to each other and the first section vent airline and the second section vent passage are fluidly coupled to each other. In further embodiments, when the first and second valve portions are moved into the closed position, the first section liquid/fuel line and the second section delivery passage are decoupled from each other and the first section vent airline and the second section vent passage are decoupled from each other.

In effect the passageway alignment assembly and the valve assembly function as two in-line valve assemblies that each separately control the flow of liquid and air from/to the portable container. This redundancy provides an additional measure of assurance that liquid and vapor should not escape from the container unless and until the passageway alignment assembly is arranged so as to align the passageways/lines and the valve assembly is moved to an open or pour position. If the passageway alignment assembly is arranged so as not to align the passageways/lines then even if the valve assembly is moved to an open or pour position; liquid and vapor will not escape from the container. Correspondingly, if the valve assembly is maintained in the closed position then even if the passageway alignment assembly is arranged so as to align the passageways/lines; liquid and vapor also will not escape from the container.

In yet further embodiments, the second section (e.g., nozzle) is rotatable coupled to the first section so as be movable between a first position and a second position. In more specific embodiments, the nozzle is rotatably coupled by the valve member. When in the first position (e.g., STORE position), the passageway alignment assembly is arranged so the first section liquid/fuel line is not aligned with the second section delivery passage and the first section airline is not aligned with the second section vent passage. Also, when in the second position (e.g., POUR position), the passageway alignment assembly is arranged to align the first section liquid/fuel line with the second section delivery passage and align the first section airline with the second section vent passage.

In yet further embodiments, the second section further includes a nozzle that is rotatable between the first position and the second position. In addition, the passageway alignment assembly is further configured to align the first section liquid/fuel line and the second section delivery passage and to align the vent airline and the second section vent passage responsive when the nozzle is rotated into the second position. Also, the passageway alignment assembly is further configured so that the first section fuel line and the second section delivery passage and the vent airline and the second section vent passage are not aligned when the nozzle is rotated into the first position. In yet further embodiments, when in the second position, the nozzle extends outwardly from the fuel/delivery nozzle of the container so that the fuel in the interior volume can be poured when the valve assembly is actuated for fluid coupling.

In yet further embodiments, the second section further includes a nozzle having a length; and each of the second section liquid/fuel delivery passage and the second section vent passage extend at least along the length of the nozzle.

In yet further embodiments, the valve assembly member further includes a biasing member that is operably coupled to the longitudinal valve member. Such a biasing member also is arranged so that the biasing member applies a force to the longitudinal member (e.g., a longitudinal force along the long axis of the to the longitudinal valve member) to maintain the longitudinal member in a desired position. In exemplary embodiments, the biasing mechanism comprises one or more springs arranged to act on the longitudinal member.

When the user applies a force (e.g., a force in the opposite direction) to actuate the actuating member and the force being applied overcomes or exceeds the force being applied by the biasing member, the actuating member moves the longitudinal member longitudinally so as to thereby open each of the first and second valve portions thereby allowing fuel and air to flow through the respective passage/line. In more specific embodiments, the seating and valve surfaces comprising each of the first and second valve portions is displaced from each other by such movement of the longitudinal member. In yet further embodiments, the biasing member applies a force to the longitudinal valve member so that each of the first and second valve portions is maintained in the closed position when the user is not actuating the actuating member.

In yet further embodiments, the second section is rotatable coupled to the first section so as be movable between the first position (e.g., STORE position) and the second position (e.g., POUR position). When in the first position, the passageway alignment assembly is arranged so the first section fuel line is not aligned with the second section fuel delivery passage and the first section airline is not aligned with the second section vent passage. In addition, when in the first position, the passageway alignment assembly is arranged to also block and seal the first section fuel line and the first section airline thereby further substantially preventing escape of volatile organic compounds from the interior volume of the fuel container to environment. In yet further embodiments, the passageway alignment assembly further comprises a sealing mechanism to block and seal the first section fuel line and the first section airline when in the first position.

In yet further embodiments, the second section further includes a hollow member operably coupled to the nozzle and a portion of which extends laterally with respect to the nozzle. In addition, the valve assembly is disposed within the laterally extending portion of the hollow member.

In more particular embodiments, the valve assembly further includes an outer member having a liquid/fuel passage and an air passage that each extend across the outer member to opposite sides thereof. When the passageway alignment assembly is arranged so the first section liquid/fuel line is aligned with the second section delivery passage and the first section airline is aligned with the second section vent passage and when the valve assembly is actuated so as to be in the open position, the liquid/fuel passage fluidly couples the first section liquid/fuel line and the second section delivery passage and the air passage fluidly couples the first section airline and the second section vent passage.

Alternatively, the valve assembly further includes an outer member having a liquid/fuel passage and an air passage extending through the outer member to opposite sides thereof and a longitudinal valve member extending within the outer member and an actuation member operably coupled to the longitudinal valve member. Such a longitudinal valve member includes a first valve portion and a second valve portion.

Thus, when the passageway alignment assembly is arranged so the first section liquid/fuel line is aligned with the second section delivery passage and the first section airline is aligned with the second section vent passage, the first valve portion is arranged to selectively couple and decouple the liquid/fuel passage of the outer member, the first section fuel line and the second section delivery passage and the second valve portion is arranged to selectively fluidly couple and decouple the air passage of the outer member, the first section vent airline and the second section vent passage, such fluid coupling and decoupling being responsive to movement of the actuation member by the user.

According to another aspect of the present invention, there is featured a portable container for the delivery, storage and/or transport of a liquid. Such a portable container includes an enclosure having an interior volume and a fill/delivery nozzle fluidly coupled to interior volume and extending outwardly from the enclosure and a nozzle and vent assembly.

Such a nozzle and vent assembly includes a first section, a second section, a passageway alignment assembly and a valve assembly. The first section is sealingly and fluidly coupled to the fill/delivery nozzle and includes a liquid line through which the liquid from the enclosure flows and a vent airline through which air flows to the interior volume. In this regard, the liquid can be a liquid organic compound, e.g., a liquid fuel such as gasoline, kerosene and diesel, however this shall not be considered limiting. The second section is movably coupled to the first section, the second section including a liquid delivery passage and an air vent passage, the air vent passage being fluidly coupled to atmosphere.

The passageway alignment assembly is disposed in the first and second sections. Also, the passageway alignment assembly is configured so as to align the first section liquid line and the second section liquid delivery passage and to align the vent airline and the second section air vent passage responsive to movement of the second section with respect to the first section.

The valve assembly includes a longitudinal valve member having first and second valve portions, and an actuation member operably coupled to the longitudinal valve member. The first valve portion and second valve portion are selectively opened and closed responsive to movement of the actuation member. In a more particular embodiment, when a sufficient force is applied to the actuation member, the longitudinal member moves along its long axis so as to thereby open the first and second valve portions. Correspondingly, the longitudinal member is biased by another force when the actuation member is not being actuated so as to maintain the first and second valve portions in the closed position.

In addition, when the first section liquid line and the second section delivery passage and the first section vent airline and the second section vent passage are aligned with respect to each other and the actuation member is moved to open the first and second valve portions, the first section liquid line and the second section delivery passage are fluidly coupled to each other and the first section vent airline and the second section vent passage are fluidly coupled to each other. In more particular embodiments, when the user de-actuates the actuation member (e.g., stops applying actuating force), thereby moving the first and second valve portions into the closed position, the first section liquid line and the second section delivery passage are fluidly decoupled from each other and the first section vent airline and the second section vent passage also are fluidly decoupled from each other.

In further embodiments, the second section (e.g., nozzle) is rotatable coupled to the first section so as be movable between a first position and a second position. When in the first position, the passageway alignment assembly is arranged so the first section liquid line is not aligned with the second section delivery passage and the first section airline is not aligned with the second section vent passage. Additionally, when in the second position, the passageway alignment assembly is arranged to align the first section liquid/fuel line with the second section delivery passage and align the first section airline with the second section vent passage. The first position generally corresponds to a store or storage position and the second position generally corresponds to a pour or liquid delivery pre-position.

In yet further embodiments, the second section further includes a nozzle that is rotatable between the first position and the second position. Also, the passageway alignment assembly is further configured to align the first section liquid/fuel line and the second section delivery passage and to align the vent airline and the second section vent passage responsive when the nozzle is rotated into the second position and the passageway alignment assembly is further configured so that the first section liquid/fuel line and the second section delivery passage and the vent airline and the second section vent passage are not aligned when the nozzle is rotated into the first position. In more particular embodiments, when in the second position, the nozzle extends outwardly from the fuel/delivery nozzle of the container so that the fuel in the interior volume can be poured when the valve assembly is actuated to open and to allow fluid coupling.

In more particular embodiments, the second section further includes a nozzle having a length; and each of the second section fuel delivery passage and the second section vent passage extend at least along the length of the nozzle.

In yet further embodiments, the valve assembly member further includes a biasing member operably coupled to the longitudinal valve member that applies a force to the longitudinal valve member. When the biasing member is applying the force to the longitudinal valve member, each of the first and second valve portions is maintained in the closed position. On the other hand, when the user applies a force to actuate the actuating member that overcomes or exceeds the force being applied by the biasing member, the actuating member moves the longitudinal member so as to open each of the first and second valve portions thereby allowing liquid/fuel and air to flow the respective passage/line;

In yet further embodiments, the second section is rotatable coupled to the first section so as be movable between a first position and a second position. When in the first position, the passageway alignment assembly is arranged so the first section liquid/fuel line is not aligned with the second section delivery passage and the first section airline is not aligned with the second section vent passage. When in the first position, the passageway alignment assembly also is arranged to also block and seal the first section liquid/fuel line and the first section airline from the second section delivery passage and the second section vent passage thereby further substantially preventing escape of volatile organic compounds from the interior volume of the fuel container to the environment. In more particular embodiments, the passageway alignment assembly further comprises a sealing mechanism (e.g., O-ring, flat ring, flat sealing membrane) that performs such blocking and sealing when in the first position.

In yet further embodiments, the second section further includes a hollow member operably coupled to the nozzle and a portion of which extends laterally with respect to the nozzle. Also, the valve assembly is disposed within the laterally extending portion of the hollow member. In more particular embodiments, the valve assembly is in sealing engagement with at least the first and second sections.

In yet further embodiments, the valve assembly further includes an outer member having a liquid passage and an air passage that each extend across the outer member to opposite sides thereof. Additionally, when the passageway alignment assembly is arranged so the first section liquid line is aligned with the second section delivery passage and the first section airline is aligned with the second section vent passage and when the valve assembly is actuated so as to be in the open position, the liquid passage fluidly couples the first section liquid line and the second section delivery passage and the air passage fluidly couples the first section airline and the second section vent passage.

In yet further embodiments, the valve assembly further includes an outer member having a liquid passage and an air passage extending through the outer member to opposite sides thereof, and a longitudinal valve member extending within the outer member and an actuation member operably coupled to the longitudinal valve member, where the longitudinal valve member includes a first valve portion and a second valve portion. Additionally, when the passageway alignment assembly is arranged so the first section liquid line is aligned with the second section delivery passage and the first section airline is aligned with the second section vent passage, (i) the first valve portion is arrangable to selectively couple and decouple the liquid passage, the first section liquid line and the second section delivery passage and (ii) the second valve portion is arrangable to selectively fluidly couple and decouple the air passage, the first section vent airline and the second section vent passage, such fluid coupling and decoupling being responsive to movement of the actuation member by the user.

According to yet another aspect of the present invention, there is featured a method for one of delivering, storing or transporting a liquid such as, for example, a fuel or a liquid organic compound. Such a method includes providing a portable container having an enclosure with an interior volume and a fill/delivery nozzle fluidly coupled to the interior volume and extending outwardly from the enclosure and a nozzle and vent assembly. Such a container and nozzle and vent assembly includes those described herein as well as that more particularly described below.

In more particular embodiments, such a nozzle and vent assembly of this aspect of the present invention includes a first section, a second section, a passageway alignment assembly and a valve assembly. The first section is sealingly and fluidly coupled to the fill/delivery nozzle, and includes a liquid line through which the liquid from the enclosure flows and a vent airline through which air flows to the interior volume. The second section is movably coupled to the first section and it includes a liquid delivery passage, an air vent passage, the air vent passage being fluidly coupled to atmosphere and a nozzle. In more particular embodiments, the second section includes a nozzle for the delivery of the liquid.

The passageway alignment assembly is disposed in the first and second sections. Also, the passageway alignment assembly is configured and arranged so as to align the first section liquid line and the second section liquid delivery passage and to align the vent airline and the second section air vent passage responsive to movement of the second section (e.g., nozzle) with respect to the first section.

The valve assembly includes a longitudinal valve member having first and second valve portions, and an actuation member operably coupled to the longitudinal valve member. The first valve portion and second valve portion are selectively opened and closed responsive to movement of the actuation member.

In further embodiments, such a method further includes, for delivering the liquid organic compound, the steps of aligning the first section liquid line and the second section delivery passage and the vent airline and the second section vent passage are aligned with respect to each other and actuating the actuation member so as to move the first and second valve portions into the open position, whereby the first section liquid line and the second section delivery passage are fluidly coupled to each other and the first section vent airline and the second section vent passage are fluidly coupled to each other; and manipulating the container so that the liquid can flow through each of the first section liquid line and the second section delivery passage to a targeted receptacle.

Other aspects and embodiments of the invention are discussed below.

DEFINITIONS

The instant invention is most clearly understood with reference to the following definitions:

ASTM International shall be understood to be referring to an international standards organization that develops and publishes voluntary consensus technical standards for a wide range of materials, products, systems and services. Until 2001, the organization was known as the American Society for Testing and Materials (ASTM). ASTM International has no role in requiring or enforcing compliance with its standards, however, the standards may become mandatory when referenced by an external contract, corporation or government. For example, ASTM standards in the United Sates have been adopted by incorporation or by reference in many federal, state or municipal government regulation.

ASTM F224-08 shall be understood to be referring to a Standard Specification for Spill Resistant Fueling Systems for Portable Fuel Containers for Consumer Use.

ASTM F852-08 shall be understood to referring to a Standard Specification for Portable Gasoline Containers for Consumer Use.

VOC as used herein shall be understood to mean volatile organic compound and VOCs shall be understood to mean volatile organic compounds.

USP shall be understood to mean U.S. Patent Number; U.S. Publication No. shall be understood to mean U.S. Published Patent Application Number; and USSN shall be understood to mean U.S. patent application serial number.

STORE position shall be understood to mean that a portable container according to the present invention, more particularly the nozzle and vent assembly of the present invention, is closed (e.g., sealed) so that liquid and any vapor within the container cannot escape from the container. More specifically, STORE also indicates that the container also is arranged to store the liquid within the container.

POUR position shall be understood to mean that a portable container according to the present invention, more particularly the nozzle and vent assembly of the present invention, is opened and thus capable of pouring liquid from the container while at the same time admitting air into the container.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein:

FIG. 8 is a perspective view of the nozzle and air vent assembly of FIG. 7 secured to a fuel container nozzle and when the nozzle is rotated into the pre-delivery position.

FIGS. 9A-D are various views of the nozzle and air vent assembly of FIG. 7; including a perspective bottom view of the assembly (FIG. 9A), an elevation side view of such an assembly showing the on-off button (FIG. 9B), another elevation view of such an assembly when in the pre-delivery position (FIG. 9C) and a bottom view of such an assembly when in the pre-delivery position (FIG. 9D).

DESCRIPTION OF THE PREFERRED EMBODIMENT

Figure 1:
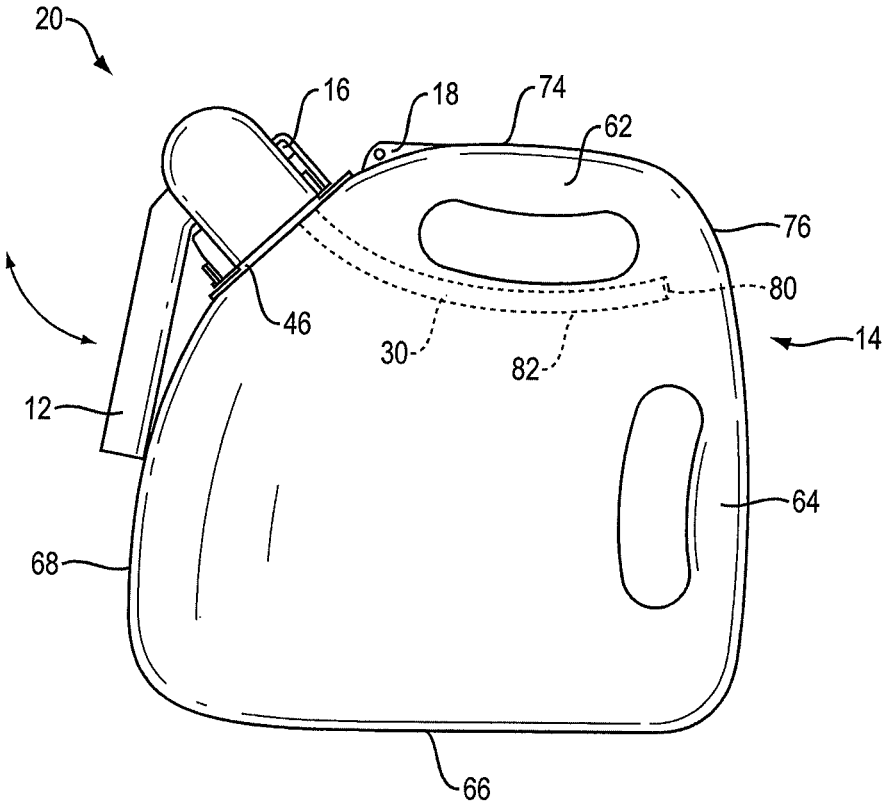
FIG. 1 illustrates a side view of a gasoline can having an air vent assembly according to one aspect of the present invention.

Referring now to the various figures of the drawing wherein like reference characters refer to like parts, there is illustrated in FIG. 1 a side view of a gasoline can 14 having an air vent assembly according to one aspect of the present invention. More particularly, the gasoline can 14 can utilize an air vent 82 according to this aspect. While the term gasoline can is used herein to describe the portable container used for transporting and storing a liquid fuel such as gasoline this shall not be considered as limiting as the portable container for the transport of a liquid fuel is commonly referred to as a gasoline can. The liquid fuel more particularly includes gasoline, diesel fuel, kerosene and other such liquid organic compounds.

In FIG. 1 can be seen gasoline can top 74, rear side 76, front side 68, bottom 66, can tether retention aperture 18, nozzle assembly tether retention aperture, top handle 62 and side handle 64. In its upright storage position, the gasoline can 14 can rest on its bottom 66 on the ground and in its use mode, when the can is lifted by the side handle 64, the bottom 66 is disposed perpendicular to the ground. In use, one grasps the side handle 64 of the gasoline can 14 which is tipped, maneuvering nozzle assembly 20 and nozzle 12 toward the object into which the fuel contained within the can 14 is to be poured such that the front side 68 is disposed to be more parallel to the ground and the side handle 64 then becomes the uppermost handle, then being the easier handle to hold in order to manipulate the end of the nozzle to its desired pouring position.

Figure 2:
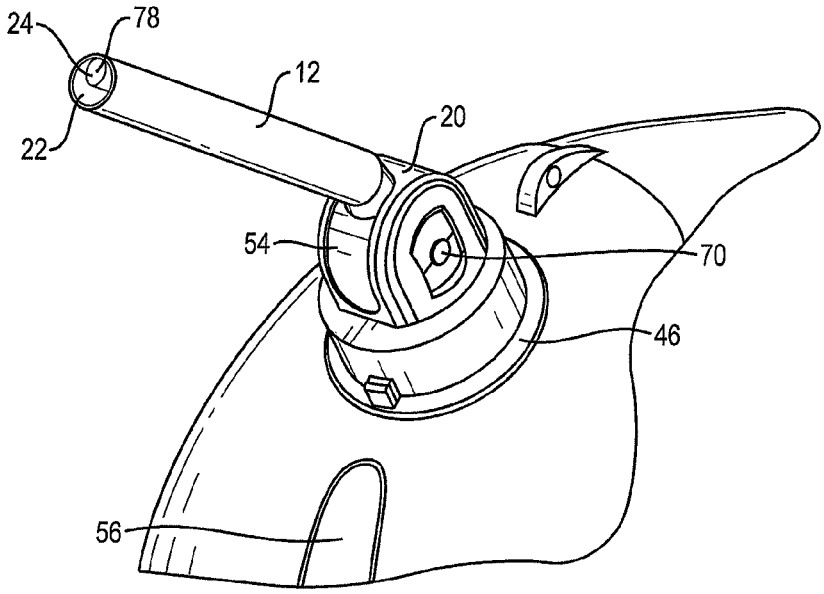
FIG. 2 illustrates an enlarged perspective view of the nozzle in an open position showing the exterior end of the nozzle air channel.
Figure 3:
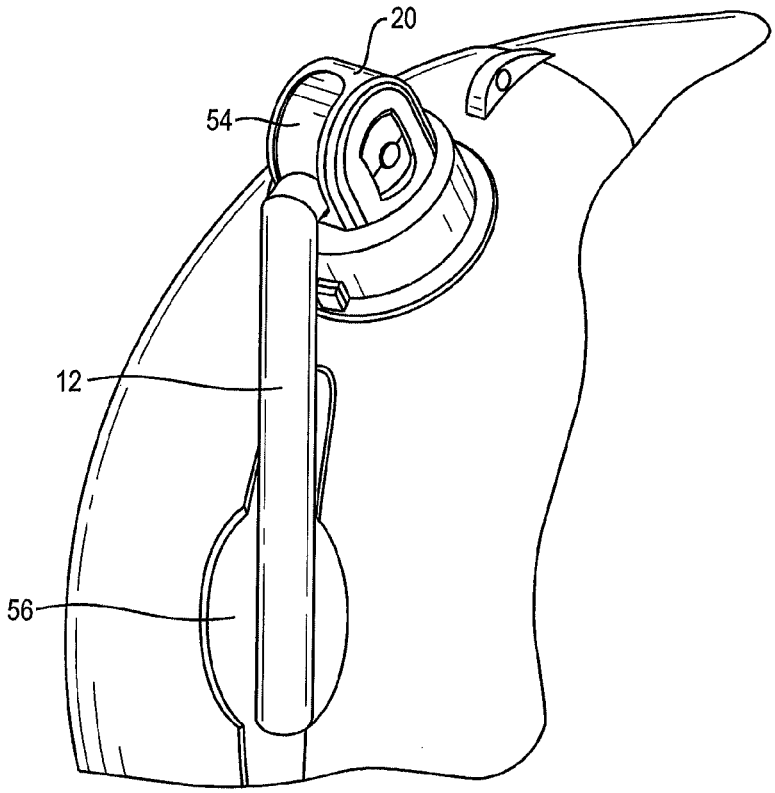
FIG. 3 illustrates an enlarged perspective vie of the nozzle of FIG. 2 in a closed position.

The nozzle 12 within the nozzle assembly 20 is seen in FIGS. 1 and 3 in its downward storage position within the nozzle receipt cavity 56 formed in the front side 68 of the can 14, as seen in FIG. 3, after it has been rotated on trunnion 70, shown in FIG. 2.

Figure 4:
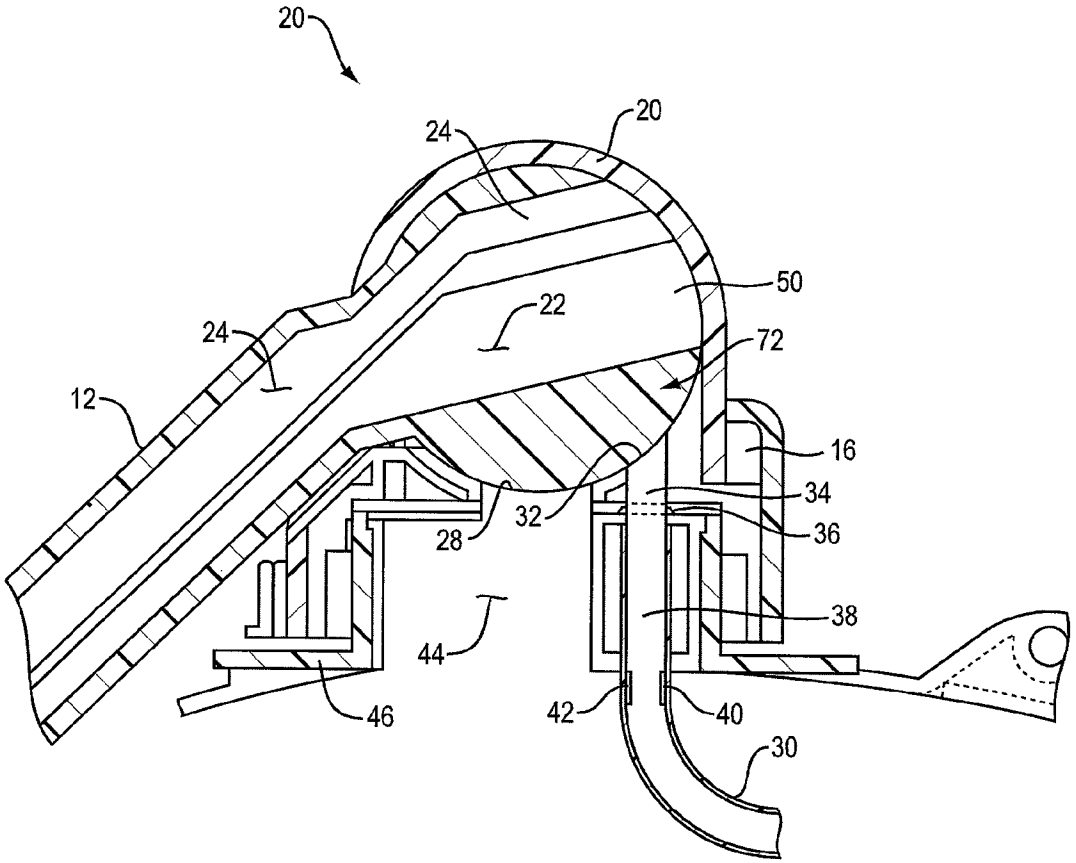
FIG. 4 illustrates an enlarged side cutaway view of the nozzle assembly in its closed mode mounted on the platform of the gasoline can and showing the tube extended therefrom but not showing the rest of the gasoline can.
Figure 5:
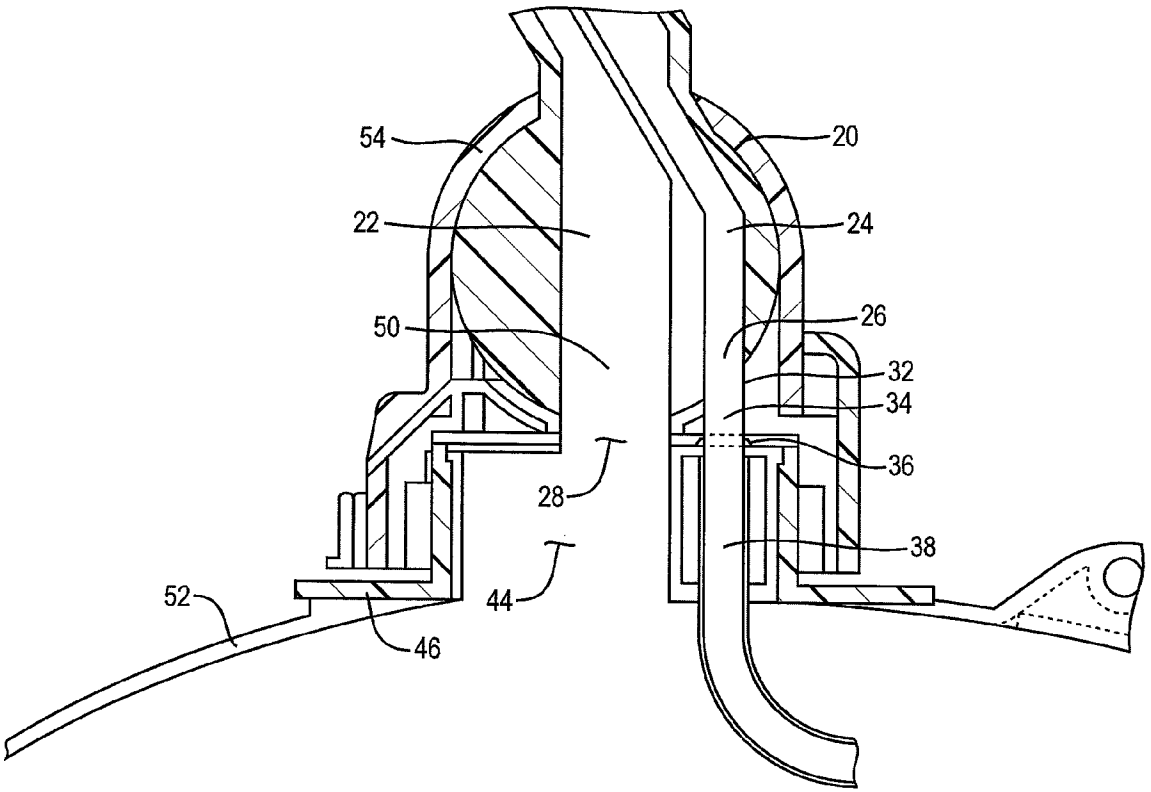
FIG. 5 illustrates an enlarged side cutaway view of the nozzle assembly of FIG. 4, showing the nozzle assembly in it open mode.
Figure 6:
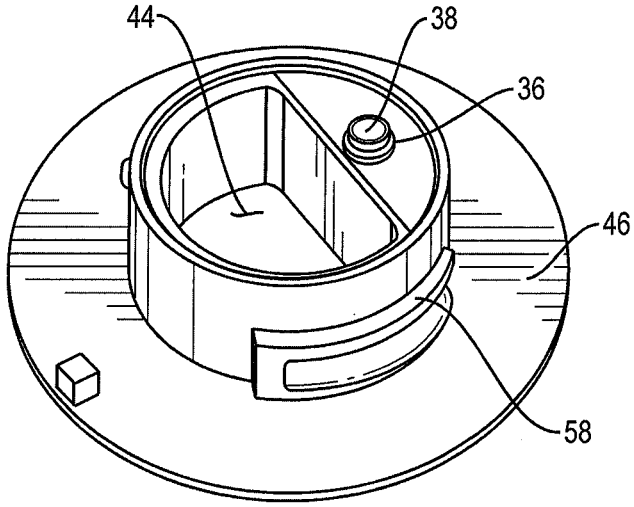
FIG. 6 illustrates a perspective view of the platform onto which the nozzle assembly would be engaged but not showing the attached gasoline can.

When the can 14 is to be used in its fuel-dispensing mode, the nozzle 12 is rotated upwards within the nozzle slot 54, as seen in FIGS. 2 and 5, to its upright position which position aligns the nozzle fuel channel 22 with the fuel opening 28 such that the nozzle assembly fuel channel opening 50 aligns with the platform fuel passage 44 as seen in FIGS. 5 and 6, allowing fuel within the can 14 to pass outward through the fuel opening 18 and out the nozzle fuel channel 22. When the nozzle 12 is maneuvered downward back to its storage mode, the ball valve 72, as seen in FIG. 4, rotates within a portion of the nozzle assembly 20 to where it is blocked, with a portion of the ball valve covering the fuel opening 28, thus sealing the can and preventing further fuel from exiting.

Disposed on the can 14 is platform 46, shown attached to the can 14 in FIG. 1, and shown separated from the can for purposes of illustration in FIG. 6. The nozzle assembly 20 threads onto a protruding portion of the platform 46 by screwing onto the engagement thread 58. Seen in FIG. 6 is the platform fuel passage 44 and also the open end if the platform air channel 38 having an air channel gasket around the end thereof. Within the nozzle assembly 20 is located a nozzle assembly air channel 34 having a tube air channel opening 32 defined at a first end thereof adjacent to the ball valve 72, as seen in FIG. 4. When the nozzle assembly is screwed onto the platform 46, the nozzle assembly air channel 34 can be aligned with the platform air channel and is sealed thereto by the air channel gasket when the valve 72 is in its open mode. At the bottom of the platform air channel 38 is a tube receipt member 40 onto which is attached a tube engagement member 42 which extends to the tube 30. The tube 3 can extend within the top handle 62 toward the can rear side 7 or be disposed within the can 14, as seen in FIG. 1.

To add fuel to the gasoline can 14, one removes the nozzle assembly 20 which has nozzle assembly tether retention aperture 16 which can be secured by a tether (not shown) to can tether retention aperture 18, as seen in FIG. 1 and pours fuel through platform fuel passage 44. When the fuel is in the can 14, one then screws the nozzle assembly 20 onto the platform 46 which aligns the nozzle assembly air channel 34 to the platform air channel, as seen in FIG. 4. When the nozzle assembly is in a closed position, as seen in FIG. 4, portions of the ball valve 72 block both the fuel opening 28 and the tub air channel opening 32.

To place the nozzle assembly in its open mode for pouring fuel from the gasoline can 14, one lifts up the nozzle 12, which action rotates the ball valve 72, causing the nozzle assembly fuel channel opening 50 to align with the fuel opening 28 and causing nozzle air channel 24 to align with the platform air channel 38, as seen in FIG. 5. In this use mode, fuel can leave the can 14 *b* traveling done nozzle fuel channel 22 to the desired location of pouring while at the same time air can pass into the nozzle air channel 24, the exterior entrance 78 of which is seen in FIG. 2. The air passes through the nozzle air channel 24, through the nozzle assembly air channel 34, through the platform air channel 38 into the tube 30 where the air can exit through air exit 80 at the interior end of tube 30 within the can 14 near rear side 76. In this way, as fuel is exiting through raised nozzle 12, air is also entering through the nozzle air channel 24 in the nozzle 12 to replace the volume of fluid leaving the can 14 to promote the easy flow of fluid out of the gasoline can 14.

Figure 7:
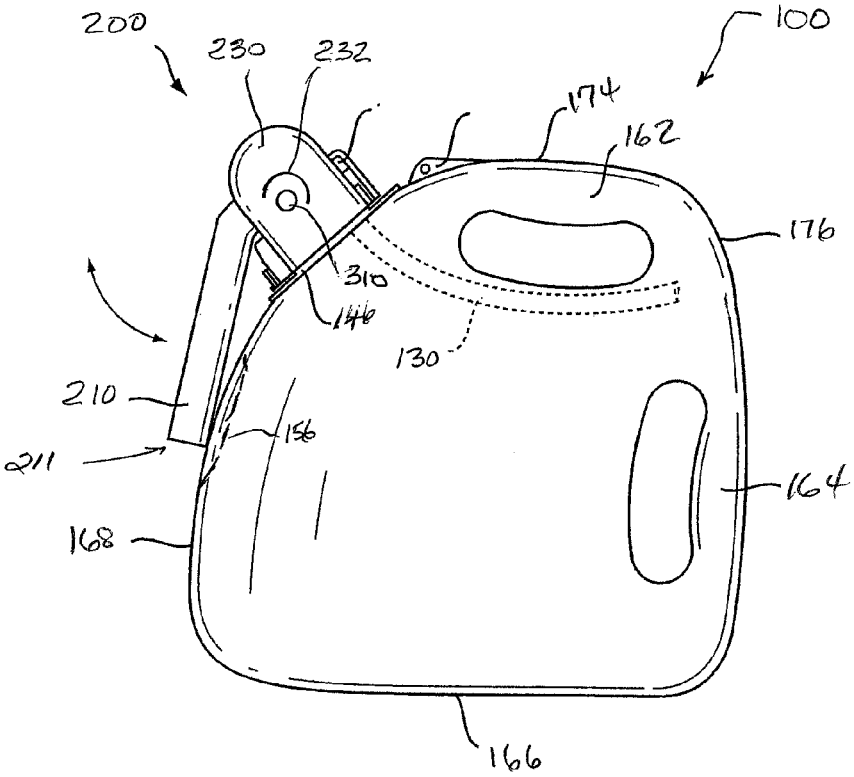
FIG. 7 is a side view of a fuel container with a nozzle and air vent assembly according to another aspect of the present invention, with the nozzle in the closed or store position.

Referring now to FIG. 7, there is shown in illustrative view of a portable container 100 including a nozzle and air vent assembly 200 both according to another aspect of the present invention. In this illustrative view, the nozzle 210 of the nozzle and vent assembly 200 also is shown in a first nozzle position or a closed or STORE position for the container. In this regard, the interior of the portable container 100 can contain a liquid such as a liquid organic compound that the user can deliver to a receptacle or device as are known in the art (e.g., a fuel tank of a motor vehicle, lawn mower, snow blower, powered saw, motor generator and the like). Such liquid organic compounds include but are not limited to gasoline, diesel, or kerosene. Such liquid organic compounds also can include alcohols (e.g., ethanol, methanol and denatured alcohol) and acetone.

Such a portable container 100 is generally configured so as to include a fill/delivery nozzle 146 or nozzle platform, a top 174, a rear side 176, a front side 168, a bottom 166, a top handle 162 and a side handle 164. In more particular embodiments, the portable container is constructed from any of number of materials as are known in the art including plastics such as polyethylene. In more specific embodiments, the fill/delivery nozzle 146 is formed integral with the body of the portable container. In an alternative embodiment, the fill delivery nozzle is formed as part of a platform like structure that is sealingly coupled (e.g., fused, glued, etc.) to the body of the portable container.

In the STORE or storage position, the portable container 100 is generally arranged so that it is upright with its bottom 166 or bottom surface resting on the ground or flat surface (e.g., floor of garage, shelf, etc.). Alternatively, a cord (e.g., bungee cord, rope, etc.) or other device (e.g., pin, hook, etc. is passed through the opening of the top handle 162 and/or side handle 164. The cord or other device is used to hang up the container 100.

The nozzle and vent assembly 200 is secured to the container's fill/delivery nozzle 146 when the portable container is being used to store, delivery or transport the liquid in the portable container. In its use mode, such as when the fluid in the container 100 is to be poured or dispensed from the container, the user manipulates (e.g., moves, rotates) the nozzle 210 from the first position shown in FIG. 1 to a second position, such as that shown in FIG. 2, where the nozzle is in a pre-delivery position for the liquid as well as the admission of gas into the container. The second position also is referred to as a pre-delivery position as the nozzle 210 when so positioned is capable of delivering the liquid after the valve assembly 300 is placed in an opened condition thereby allowing the liquid or fuel to flow from the container and thence through the nozzle 210.

As shown in more detail in FIGS. 8-9, an actuation member 310 of a valve assembly 300 (see FIGS. 10-11) extends outwardly from a second part 230 of the nozzle and vent assembly 200. In more particular embodiments, the second part 230 also is provided with a shield member 232 that extends about the actuation member 310. When the nozzle 210 is moved into the second position using the slot 254, 254*a* or opening provided in the first and second parts 220, 230, the user can actuate the actuation member 310 so as to thereby fluid couple the nozzle 210 to the interior volume of the container and so as to thereby allow the fluid to flow from the container into the receptacle or device (e.g., nozzle of a fuel tank) receiving the fluid and also to thereby allow air or other gas to flow into the container as the liquid is exiting.

When in use, the user also manipulates the portable container 100 such as by using the top handle 162 and/or the side handle 164 so that the nozzle 210 when in its second position, its deployed position, its pre-delivery position or its POUR position is proximal to or disposed in the receipt cavity or nozzle of the receptacle, object or device which is to receive the liquid. The user also further manipulates the container so it is appropriately positioned so that the liquid inside the container can be poured from the container into the receptacle. For example, the container is manipulated so the front side 168 thereof is at an angle with respect to the ground (e.g., an acute angle between ground and a projection of the front side).

The container 100, more particularly the front side 168 of the container, also is configured so as to include a depressed region or cavity 156 therein (see also FIGS. 2-3). The depressed cavity 156 is formed in the container front side so as to extend laterally and lengthwise a sufficient distance so as to receive therein at least a portion of the nozzle 210 including the open end 211 thereof after the nozzle has been rotated or moved into the first position (see also FIG. 3). This arrangement has the beneficial effect of minimizing the potential for something grabbing onto or hitting the nozzle while the container is resting on the ground or flat surface and thus, causing the portable container to fall over.

When liquid is to be added to the container 100 (e.g., container is to be partially or completely filled), the container bottom 166 also is typically placed on the ground or a flat surface and the nozzle and vent assembly 200 is removed (e.g., unscrewed) from the fill/delivery nozzle 146. Thereafter, the user inserts the liquid delivery nozzle/hose of an external source of fluid into the fill/delivery nozzle 146 and then takes the appropriate actions to fill or add the liquid to the portable container. For example, if the liquid delivery nozzle includes a trigger to control dispensing of the liquid, the user would actuate the trigger to allow fluid to flow into the container.

Referring now to FIGS. 8-12, there is show various views of a nozzle and vent assembly 200 according to the present invention. More particularly, FIG. 8 is a perspective view of the nozzle and air vent assembly 200 that is secured to the fuel fill/delivery nozzle 146 of the container 100 and when the nozzle is rotated into the second position. Also, FIGS. 9A-D are various views of the nozzle and air vent assembly 200; including a perspective bottom view of the assembly (FIG.

Figure 10:
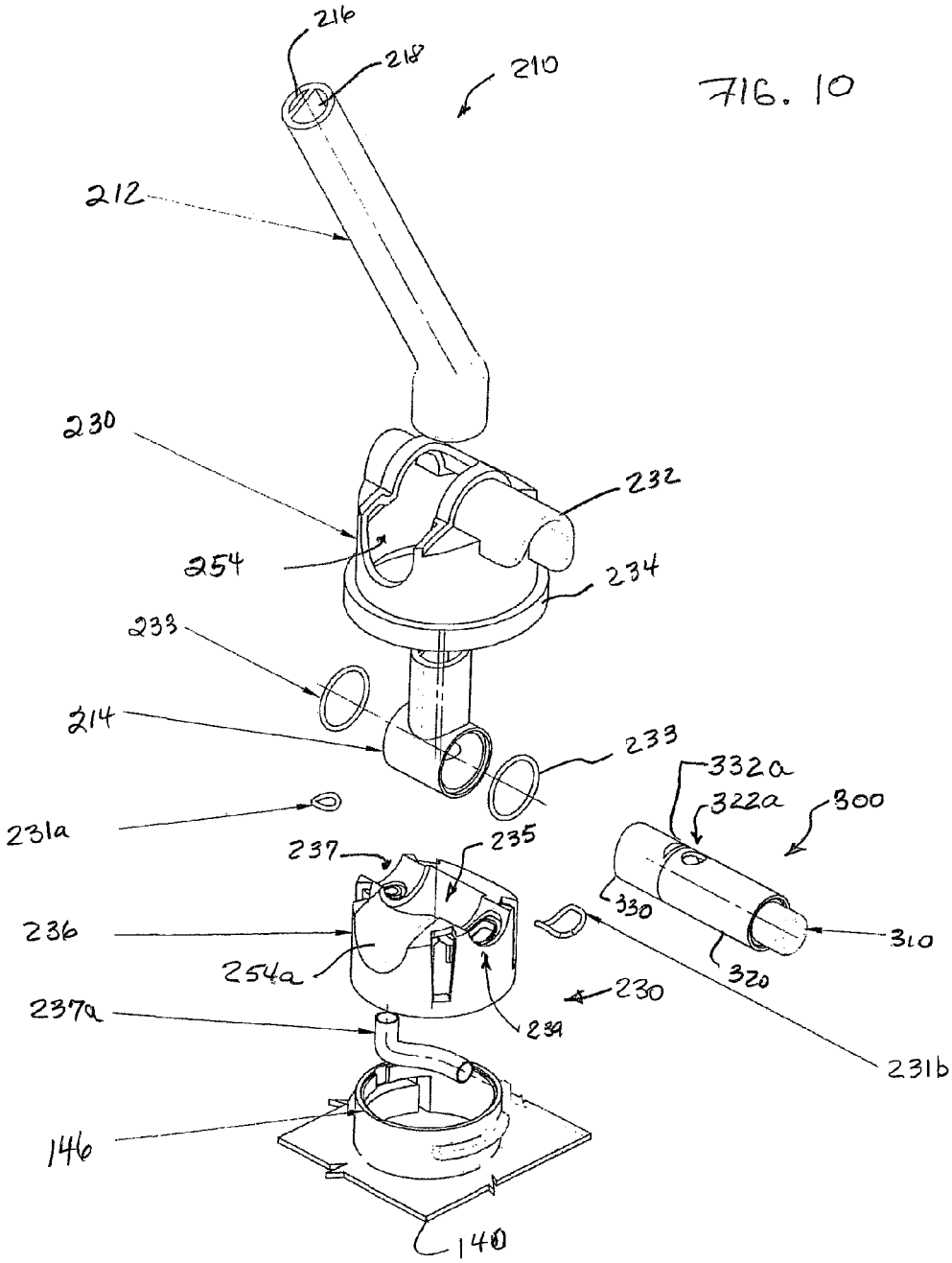
FIG. 10 is an exploded view of a nozzle and air vent assembly of FIG. 8.
Figure 11:
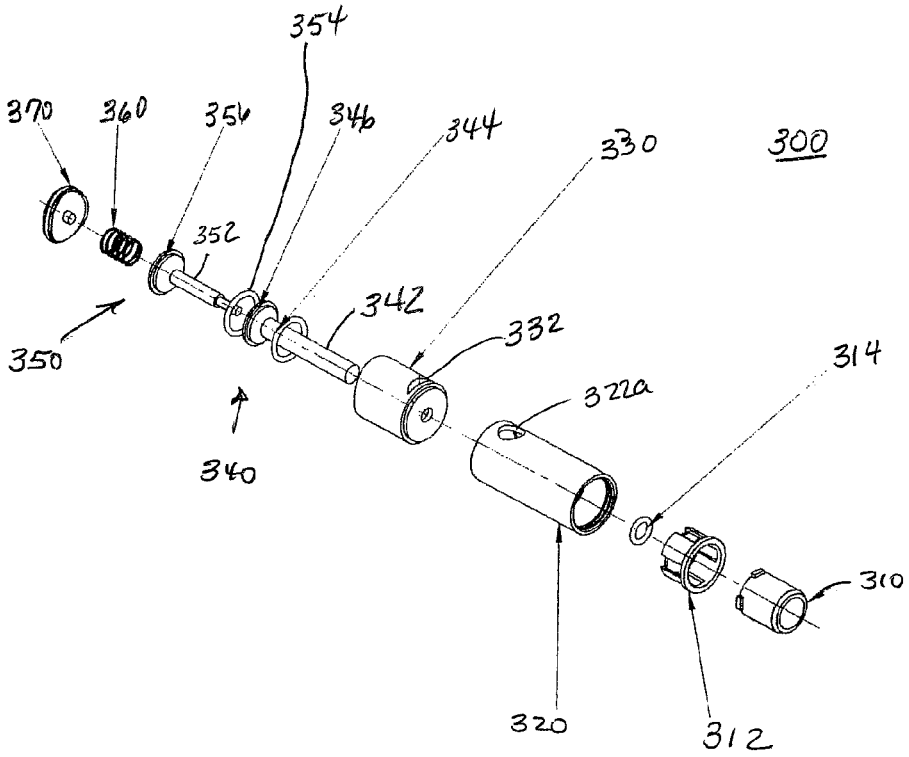
FIG. 11 is an exploded view of a valve assembly of the nozzle and air vent assembly of FIG. 10.
Figure 12:
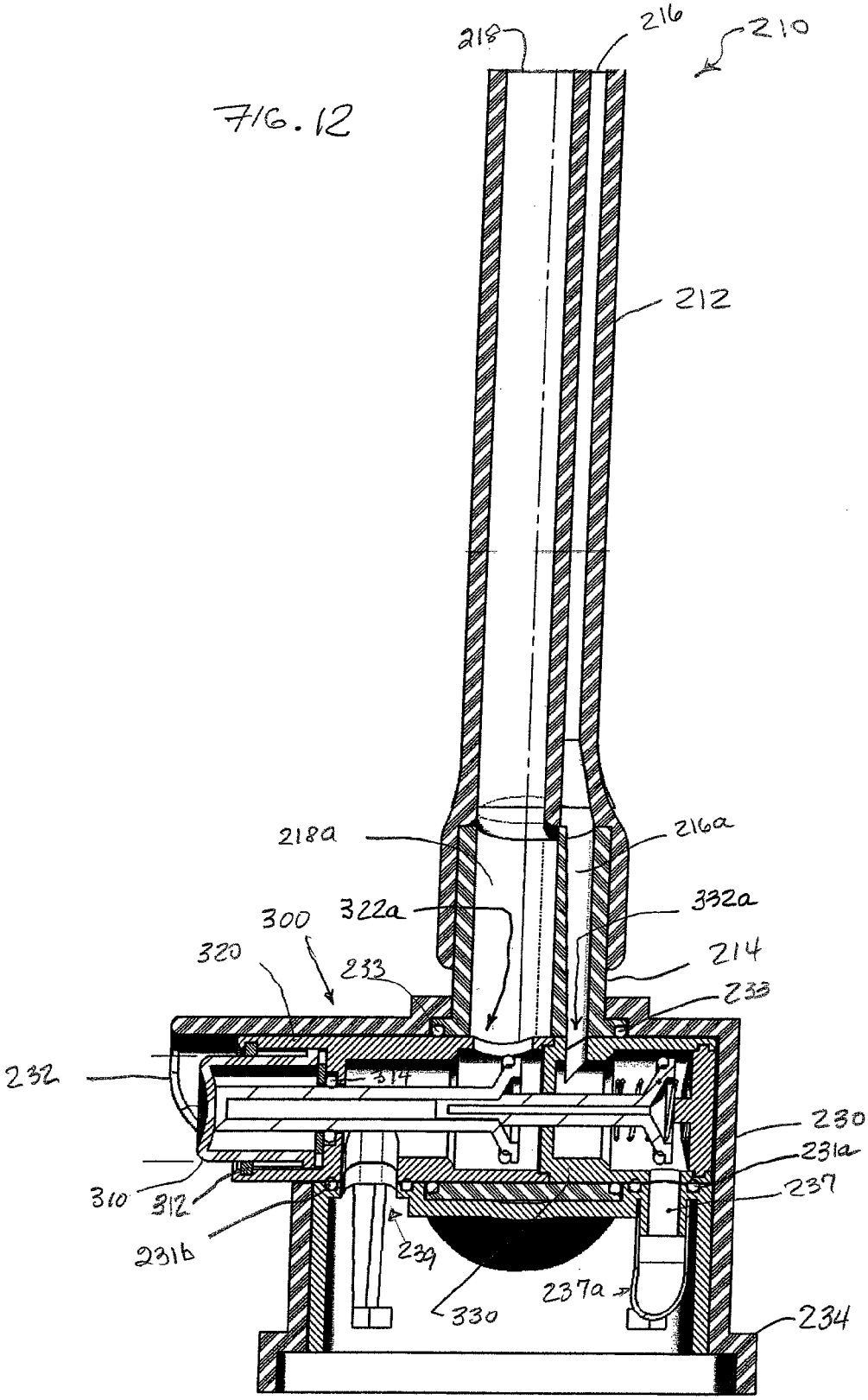
FIG. 12 is a sectional view of the nozzle and air vent assembly when configured in the fuel delivery position and including when the button or actuation member is actuated to allow delivery of liquid/fuel from the fuel container and air into the container.

9A), an elevation side view of such an assembly showing the on-off button comprising the actuation member 310 (FIG. 9B), another elevation view of such an assembly when in the pre-delivery position (FIG. 9C) and a bottom view of such an assembly (FIG. 9D). Further, FIG. 10 is an exploded view of the nozzle and air vent assembly 200 of FIG. 8. Additionally, FIG. 11 is an exploded view of the valve assembly 300 and FIG. 12 is a sectional view of such a nozzle and air vent assembly 200 when in the fuel delivery position including when the button or actuation member is actuated to allow delivery of liquid/fuel from the fuel container and air into the container.

The nozzle and vent assembly 200 of the present invention includes a nozzle 210, a first part 220, a second part 230 and a valve assembly 300. As indicated herein, the second part 230 is connected to the fill/delivery nozzle 146 of the container so as to form a fluid seal and mechanical connection between the container 100 and the nozzle and fuel assembly 200. In more particular embodiments, and as shown in FIG. 10, the second part includes a threaded hub 234 and the fill/delivery nozzle 146 includes complementary threads so that the second part is threadably secured to the fill/delivery nozzle to form the fluid seal and mechanical connection.

In yet further embodiments, the exterior of the second part 230, for example the threaded hub 234 includes an exterior mounted artifact and the exterior of the container 100 proximal the fill/delivery notice also includes a complimentary artifact. These two artifacts are configured and arranged so as to releasably secure the nozzle and vent assembly 200 (the second part thereof) to the container 100 thereby minimizing the potential for the nozzle and vent assembly from becoming loose and thus minimizing the potential for leakage of fluid from the container.

In further embodiments, at least a portion of the first part 220 extends inside the fill delivery nozzle 146 thereby fluidly coupling portions of the first section with the interior volume of the container. In more particular embodiments, fluid and air passages of the first part 220 are arranged so the open ends thereof are fluidly coupled to the container interior by means of the fill delivery nozzle 146.

In alternative embodiments, the nozzle and vent assembly further includes a line extension 130 that is fluidly coupled to an air passage in the first section 220. As illustrated in FIG. 7, the line extension 130 extends away from the fill/delivery nozzle 146 so that the open end 131 of the line extension is disposed at a distance from the fill/delivery nozzle (e.g., the opening 131 is not adjacent to the fill/delivery nozzle). For example, the open end of the line extension is disposed close or proximal to the rear side 176 and the top 174 of the container. It should be noted that as described further herein, it is within the scope of the present invention for the nozzle/vent assembly 200 to be configured so that the portions of the air and fluid passages/lines of the first section 220 are fluidly coupled to the container's interior volume in general proximity to the first section or fill delivery nozzle 146, e.g., such as shown in FIGS. 9A, D and FIG. 12.

The nozzle 210 includes a first section 212 and a second section 214 that are joined to each other such that an air passage or line 216 of the nozzle first section is fluidly coupled to the air passage or line 216*a* of the nozzle second section. Similarly, the nozzle first and second sections 212, 214 are joined to each other so that a liquid passage or line 216 of the nozzle first section is fluidly coupled to the liquid passage or line 216*a* of the nozzle second section.

In particular embodiments, the nozzle second section 214 is configured to form a T-shaped member that is received in an aperture (e.g., bell mouth end) in the nozzle first section 212 as shown in FIG. 12. As also shown in FIGS. 10 and 12, the horizontal portion of the T-shaped nozzle second section 214 is movable secured (e.g., rotatable secured) to each of the first part 220 and the second part 230 or cap by means of the valve assembly 300. In this way, the nozzle 210 can be rotated between the first and second positions (i.e., the STORE position and POUR or pre-delivery position) about the valve assembly 300.

As shown in FIG. 10, when the nozzle is in the second position, the POUR position or the pre-delivery position, the open end of the nozzle second section fluid line 216*a* is aligned with respect to an open end of the second part fluid passage or line 239. Similarly, the nozzle second section airline 216*a* also is aligned with the open end of the second part airline 237 when in the second or POUR position. As also shown in FIGS. 9D, 10 and 12, an extension line 237*a* can be secured to the second part airline to extend the airline further from the first section 220 within the fill delivery nozzle 146.

In this regard, the term "align" is used herein to indicate that the flow pathways are aligned fluidly such that when the intervening valve assembly 300 is opened, liquid or air can flow through and between the fluid/air passages or lines of the first and second parts 220, 230. This term does not necessarily mean that the flow pathways or the entrances/exits of such flow pathways are physically aligned or concentric with respect to each other. However, it is within the scope of the present invention for such pathways or portions of such pathways to be physically aligned or concentric with respect to each other. In further embodiments, and as illustrated in FIG. 12, the valve assembly 300 is configurable so as to define further passages or lines (one for each of fluid and air) therein, which passages/lines extend at least in part lengthwise or longitudinally within the valve assembly. In such a case, the air and fluid lines 218*a*, 216*a* of the nozzle are longitudinally displaced with respect to the air and fluid passages of the first part 220.

As indicated in the above discussion regarding FIGS. 1-6, when the nozzle is moved or rotated into the first position or the STORE position, the liquid/air passages or lines in the nozzle and those of the platform are not aligned and also are no longer fluidly coupled to each other. Similarly, when the nozzle 210 according to this aspect of the present invention is moved or rotated into the first position, the air/liquid lines 218*a*, 216*a* of the nozzle second section are no longer aligned with the air/liquid lines 237, 239 of the first part 220. Thus, even if one actuated the valve assembly 300 to open it, there would be no fluid coupling between the air/liquid passageways/lines of the nozzle and the first part 220.

In more particular embodiments, the entrances of the air/liquid lines 237, 239 of the first part 220 are each configured so as to include an O-ring 231*a,b* that extends about the entrances and so as to contact an outer surface of the valve assembly outer members 320, 330 so as to form a pressure barrier and to seal the air/liquid lines to prevent leakage of air or liquid. Thus, when the nozzle 210 is moved or rotated to the first position, neither air or liquid can leak past the O-ring to the nozzle or the outside. While the embodiment depicts and O-ring, it should be recognized that any of a number of means known to those skilled in the art (e.g., washers, raised sliding surfaces) may be used to accomplish such a sliding and sealing effect.

Thus, when the nozzle 210 is in the second position, the POUR position or the pre-delivery position the closed valve assembly 300 maintains the storage condition of the portable container 100 unless and until the valve assembly is actuated to open. Also, when the nozzle is in the first position or the STORE position, the storage condition of the portable container is maintained by the valve assembly 300 and also because of the non-alignment of liquid/air passages. Moreover, even if the valve assembly 300 was somehow actuated when the nozzle is in the first position, there still should be no leakage of liquid and vapor because the nozzle is in the first position thus blocking fluid (air and liquid) flow to/from the portable container.

As shown in FIGS. 10-12, the first nozzle 210 is inserted in to the second part 230 so that the T-shaped nozzle section 214 extends outwardly through the slot 254. In addition, the first part is inserted into the second part and so the laterally or longitudinally extending portion of the T-shaped nozzle second section 214 is received in a depression 235 formed in the nozzle assembly first part 220. The depression 235 is shaped so as to allow the rotational movement of the nozzle second section.

The valve member 300 is arranged so it passes through the side opening in the second section 230 about which extends the protective shield 232 for the actuation member 310. The valve member 310 also is arranged to further extend through the aperture or passage in the laterally or longitudinally extending portion of the T-shaped nozzle second section 214. O-rings 233 or other sealing mechanisms or devices are disposed at either end of the aperture so as to sealingly engage the outer surface of the valve member outer members 320, 332 thereby creating a pressure barrier to minimize or eliminate leakage of liquid and/or air from the openings 322*a*, 332*b* (e.g., entrances/exits) for the air/liquid lines to the individual liquid/air valve portions 340, 350 of the valve member 300. These O-rings also allow the T-shaped member to rotate about the valve member 300.

As indicated above, the openings 322*a*, 332*b* (e.g., entrances/exits) for the air/liquid lines of the valve member are fluidly coupled to the individual liquid/air valve portions 340, 350 of the valve member 300. In addition, the other openings 322*b*, 332*b* for the liquid/air lines of the valve member are fluidly coupled to the individual valve portions 340, 35. As indicated herein, these valve portions 340, 350 are biased closed by a biasing mechanism, thus fluidly de-coupling the openings 322*a*, 332 from the other openings 322*b*, 332*b*. On the other hand when the actuation member 310 is actuated, the individual valve portions 340, 350 are opened thereby fluidly coupling the openings 322*a*, 332 with the other openings 322*b*, 332*b* and thereby allowing the flow of liquid and air from/to the container.

The valve assembly 300 includes an outer member having a first section 320 and a second section 330 a longitudinal member including the first and second valve portions 340, 350, an actuation member 310 that is operably coupled to the longitudinal member and a biasing mechanism also operably coupled to the longitudinal member. As describe herein, the biasing mechanism is configured and arranged so as to apply a force to each of the valve portions 34, 350 of the longitudinal member so as to cause each of the valve portions into sealing engagement with a seating surface thereby closing the valve portions. Also described herein, when a sufficient force is applied to the actuation member 310 such a force also is applied to the longitudinal member thereby causing each of valve portions 340, 350 to move away from the seating surfaces thereby opening each of the valve portions.

The first valve portion 340 also is arranged so that it is slidingly disposed in the outer member first section 320. More specifically, the first valve portion includes a moving member having a disc shaped end 346 that is slidingly disposed within an aperture in the outer member first section 320, a rod like member 342 extending from the disc shaped end and a sealing device 344 such as an O-ring that engages the disc shaped end. The sealing device 344 is arranged on the disc shaped end and the length of the rod like member 342 is established so that the sealing device engages a seating surface (preferably provided on an interior portion of the outer member first section) when the first valve portion 340 is biased closed by the biasing mechanism. Correspondingly, when a sufficient force is applied to the rod like member and to overcome the biasing force, the force causes the sealing device to be urged away from the seating surface thereby opening the first valve portion.

The rod like member 342 and the outer member first section 320 also are arranged so the rod like member passes through an opening in a recessed end surface in the outer member first section. Also, an end of the rod like member is operably and mechanically engaged with the actuation member 310. Another sealing mechanism such as an O-ring 314 is disposed in the opening in the recessed end surface so as to sealingly and slidably engage the rod like member. In exemplary embodiments, the actuation member 320 and O-ring 314 are preferably secured in place by an O-ring/button retainer 312 as is known to those skilled in the art.

The second valve portion 350 also is arranged so that it is slidingly disposed in the outer member second section 330. More specifically, the second valve portion includes a moving member having a disc shaped end 356 that is slidingly disposed within an aperture in the outer member second section 330, a rod like member 352 extending from the disc shaped end and a sealing device 354 such as an O-ring that engages the disc shaped end. The sealing device 354 is arranged on the disc shaped end and the length of the rod like member 352 is established so that the sealing device engages a seating surface (preferably provided on an interior portion of the outer member second section) when the first valve portion 350 is biased closed by the biasing mechanism. Correspondingly, when a sufficient force is applied to the rod like member and to overcome the biasing force, the force causes the sealing device to be urged away from the seating surface thereby opening the second valve portion.

The rod like member 352 and the outer member second section 350 also are arranged so the rod like member passes through an opening in an end surface in the outer member second section. Also, an end of the rod like member is operably and mechanically engaged with the rod like member 342 of the first valve portion 340. In alternative embodiments, another sealing mechanism such as an O-ring is disposed in the opening to sealingly and slidably engage the rod like member 352.

In further embodiments, an end of the outer member first section 320 and an opposing end of the outer member second section 330 (i.e., the end with the opening for the rod like member) are configured and arranged such that these two ends are sealingly engaged with each other. In an exemplary embodiment, the ends are arranged with a ship lap construction having two overlapping end structures as illustrated in FIG. 12.

A biasing mechanism, such as spring 360 is disposed between a surface if disc shaped member 356 of the second valve portion 350 and an end cap 370. The end cap 370 is secured to an end surface of the outer member second section 332, the end surface opposite to the connection between the outer member first and second sections 320, 330. This traps the spring in compressed fashion between the end cap 370, the outer member second section 330 and the disc shaped member 356 of the second valve portion 350. IN this way, a force is applied along the length of each of the rod like members for the first and second valve portions 340, 350 thereby biasing the valve portions in a closed position.

In alternative embodiments, and as illustrated in FIG. 12, the biasing mechanism can comprise two springs one disposed between the end cap 370 and the disc shaped member 356 of the second valve portion 350 and a second spring disposed on the other side of the disc shaped member 356 between the disc shaped member and structure of the outer member second section 330.

Although a preferred embodiment of the invention has been described using specific terms, such description is for illustrative purposes only, and it is to be understood that changes and variations may be made without departing from the spirit or scope of the following claims.

INCORPORATION BY REFERENCE

All patents, published patent applications and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

What is claimed is:

1. A delivery nozzle and vent assembly for a portable container containing a liquid organic compound, the portably container including a fill/delivery nozzle and an interior volume, the delivery nozzle and vent assembly comprising:

a first section that is operably and fluidly coupled to the fill/delivery nozzle and the interior volume of the fuel container, the first section including a fuel line through which fuel from the container flows and a vent airline through which air flows to the interior volume;

a second section that is movably coupled to the first section, the second section include a fuel delivery passage through which fuel flows from the first section and an air vent passage through which air flows to the first section;

a passageway alignment assembly disposed in the first and second sections, the passageway alignment assembly being configured so as to align the first section fuel line and the second section fuel delivery passage and to align the vent airline and the second section vent passage responsive to movement of the second section with respect to the first section;

a valve assembly that includes a longitudinal valve member having a first and second valve portions, and an actuation member operably coupled to the longitudinal valve member, where the first valve portion and second valve portion are selectively opened and closed responsive to movement of the actuation member;

wherein, when the first section fuel line and the second section delivery passage and the vent airline and the second section vent passage are aligned with respect to each other and the actuation member is moved to open the first and second valve portions, the first section fuel line and the second section delivery passage are fluidly coupled to each other and the first section vent airline and the second section vent passage are fluidly coupled to each other.

2. The delivery nozzle and vent assembly of claim 1, wherein when the first and second valve portions are moved into the closed position the first section fuel line and the second section delivery passage are decoupled from each other and the first section vent airline and the second section vent passage are decoupled from each other.

3. The delivery nozzle and vent assembly of claim 1, wherein:

the second section is rotatable coupled to the first section so as be movable between a first position and a second position;

when in the first position, the passageway alignment assembly is arranged so the first section fuel line is not aligned with the second section delivery passage and the first section airline is not aligned with the second section vent passage; and when in the second position, the passageway alignment assembly is arranged to align the first section fuel line with the second section delivery passage and align the first section airline with the second section vent passage.

4. The delivery nozzle and vent assembly of claim 1, wherein:

the second section further includes a nozzle that is rotatable between a first position and a second position;

the passageway alignment assembly is further configured to align the first section fuel line and the second section delivery passage and to align the vent airline and the second section vent passage responsive when the nozzle is rotated into the second position; and the passageway alignment assembly is further configured so that the first section fuel line and the second section delivery passage and the vent airline and the second section vent passage are not aligned when the nozzle is rotated into the first position.

5. The delivery nozzle and vent assembly of claim 4, wherein, when in the second position, the nozzle extends outwardly from the fuel/delivery nozzle of the container so that the fuel in the interior volume can be poured when the valve assembly is actuated for fluid coupling.

6. The delivery nozzle and vent assembly of claim 1, wherein the second section further includes a nozzle having a length; and each of the second section fuel delivery passage and the second section vent passage extend at least along the length of the nozzle.

7. The delivery nozzle and vent assembly of claim 1, wherein the valve assembly member further includes a biasing member operably coupled to the longitudinal valve member and wherein the biasing member applies a force to the longitudinal valve member and wherein, when the user applies a force to actuate the actuating member that overcomes the force being applied by the biasing member, the actuating member moves the longitudinal member so as to open each of the first and second valve portions thereby allowing fuel and air to flow the respective passage/line.

8. The delivery nozzle and vent assembly of claim 1, wherein the valve assembly member further includes a biasing member operably coupled to the longitudinal valve member and wherein the biasing member applies a force to the longitudinal valve member so that each of the first and second valve portions is maintained in the closed position when the user is not actuating the actuating member.

9. The delivery nozzle and vent assembly of claim 1, wherein:

the second section is rotatable coupled to the first section so as be movable between a first position and a second position;

when in the first position, the passageway alignment assembly is arranged so the first section fuel line is not aligned with the second section fuel delivery passage and the first section airline is not aligned with the second section vent passage;

when in the first position, the passageway alignment assembly also is arranged to also block and seal the first section fuel line and the first section airline thereby further substantially preventing escape of volatile organic compounds from the interior volume of the fuel container to environment.

10. The delivery nozzle and vent assembly of claim 9, wherein the passageway alignment assembly further comprises a sealing mechanism to block and seal the first section fuel line and the first section airline when in the first position.

11. The delivery nozzle and vent assembly of claim 1, wherein:

the second section further includes a hollow member operably coupled to the nozzle and a portion of which extends laterally with respect to the nozzle; and the valve assembly is disposed within the laterally extending portion of the hollow member.

12. The delivery nozzle and vent assembly of claim 11, wherein:

the valve assembly further includes an outer member having a fuel passage and an air passage that each extend across the outer member to opposite sides thereof; and when the passageway alignment assembly is arranged so the first section fuel line is aligned with the second section delivery passage and the first section airline is aligned with the second section vent passage and when the valve assembly is actuated so as to be in the open position, the fuel passage fluidly couples the first section fuel line and the second section fuel delivery passage and the air passage fluidly couples the first section airline and the second section vent passage.

13. The delivery nozzle and vent assembly of claim 11, wherein the valve assembly further includes:

an outer member having a fuel passage and an air passage extending through the outer member to opposite sides thereof, and a longitudinal valve member extending within the outer member and an actuation member operably coupled to the longitudinal valve member, where the longitudinal valve member includes a first valve portion and a second valve portion; and wherein, when the passageway alignment assembly is arranged so the first section fuel line is aligned with the second section fuel delivery passage and the first section airline is aligned with the second section vent passage, the first valve portion is arranged to selectively couple and decouple the fuel passage, the first section fuel line and the second section delivery passage and the second valve portion is arranged to selectively fluidly couple and decouple the air passage, the first section vent airline and the second section vent passage, such fluid coupling and decoupling being responsive to movement of the actuation member by the user.

14. A portable container for delivery, storage and/or transport of a liquid organic compound, the portable container comprising:

an enclosure having an interior volume and a fill/delivery nozzle fluidly coupled to interior volume and extending outwardly from the enclosure;

a nozzle and vent assembly, wherein the nozzle and vent assembly includes:

a first section that is sealingly and fluidly coupled to the fill/delivery nozzle, the first section including a liquid line through which the liquid from the enclosure flows and a vent airline through which air flows to the interior volume;

a second section that is movably coupled to the first section, the second section including a liquid delivery passage and an air vent passage, the air vent passage being fluidly coupled to atmosphere;

a passageway alignment assembly disposed in the first and second sections, the passageway alignment assembly being configured so as to align the first section liquid line and the second section liquid delivery passage and to align the vent airline and the second section air vent passage responsive to movement of the second section with respect to the first section;

a valve assembly that includes a longitudinal valve member having first and second valve portions, and an actuation member operably coupled to the longitudinal valve member, where the first valve portion and second valve portion are selectively opened and closed responsive to movement of the actuation member;

wherein, when the first section liquid line and the second section delivery passage and the vent airline and the second section vent passage are aligned with respect to each other and the actuation member is moved to open the first and second valve portions, the first section liquid line and the second section delivery passage are fluidly coupled to each other and the first section vent airline and the second section vent passage are fluidly coupled to each other.

15. The portable container of claim 14, wherein when the user de-actuates the actuation member, thereby moving the first and second valve portions into the closed position, the first section liquid line and the second section delivery passage are decoupled from each other and the first section vent airline and the second section vent passage are decoupled from each other.

16. The portable container of claim 14, wherein:

the second section is rotatable coupled to the first section so as be movable between a first position and a second position;

when in the first position, the passageway alignment assembly is arranged so the first section fuel line is not aligned with the second section delivery passage and the first section airline is not aligned with the second section vent passage; and when in the second position, the passageway alignment assembly is arranged to align the first section fuel line with the second section delivery passage and align the first section airline with the second section vent passage.

17. The portable container of claim 14, wherein:

the second section further includes a nozzle that is rotatable between a first position and a second position;

the passageway alignment assembly is further configured to align the first section fuel line and the second section delivery passage and to align the vent airline and the second section vent passage responsive when the nozzle is rotated into the second position; and the passageway alignment assembly is further configured so that the first section fuel line and the second section delivery passage and the vent airline and the second section vent passage are not aligned when the nozzle is rotated into the first position.

18. The portable container of claim 17, wherein, when in the second position, the nozzle extends outwardly from the fuel/delivery nozzle of the container so that the fuel in the interior volume can be poured when the valve assembly is actuated for fluid coupling.

19. The portable container of claim 14, wherein the second section further includes a nozzle having a length; and each of the second section fuel delivery passage and the second section vent passage extend at least along the length of the nozzle.

20. The portable container of claim 14, wherein:

the valve assembly member further includes a biasing member operably coupled to the longitudinal valve member and applying a force to the longitudinal valve member;

when the biasing member is applying the force to the longitudinal valve member, each of the first and second valve portions is maintained in the closed position; and when the user applies a force to actuate the actuating member that overcomes the force being applied by the biasing member, the actuating member moves the longitudinal member so as to open each of the first and second valve portions thereby allowing fuel and air to flow the respective passage/line.

21. The portable container of claim 14, wherein:

the second section is rotatable coupled to the first section so as be movable between a first position and a second position;

when in the first position, the passageway alignment assembly is arranged so the first section fuel line is not aligned with the second section fuel delivery passage and the first section airline is not aligned with the second section vent passage;

when in the first position, the passageway alignment assembly also is arranged to also block and seal the first section fuel line and the first section airline thereby further substantially preventing escape of volatile organic compounds from the interior volume of the fuel container to environment.

22. The portable container of claim 21, wherein the passageway alignment assembly further comprises a sealing mechanism to block and seal the first section fuel line and the first section airline when in the first position.

23. The portable container of claim 14, wherein:

the second section further includes a hollow member operably coupled to the nozzle and a portion of which extends laterally with respect to the nozzle;

the valve assembly is disposed within the laterally extending portion of the hollow member.

24. The portable container of claim 23, wherein:

the valve assembly further includes an outer member having a liquid passage and an air passage that each extend across the outer member to opposite sides thereof; and when the passageway alignment assembly is arranged so the first section liquid line is aligned with the second section delivery passage and the first section airline is aligned with the second section vent passage and when the valve assembly is actuated so as to be in the open position, the liquid passage fluidly couples the first section liquid line and the second section delivery passage and the air passage fluidly couples the first section airline and the second section vent passage.

25. The portable container of claim 23, wherein the valve assembly further includes:

an outer member having a liquid passage and an air passage extending through the outer member to opposite sides thereof, and a longitudinal valve member extending within the outer member and an actuation member operably coupled to the longitudinal valve member, where the longitudinal valve member includes a first valve portion and a second valve portion; and wherein, when the passageway alignment assembly is arranged so the first section liquid line is aligned with the second section delivery passage and the first section airline is aligned with the second section vent passage, (i) the first valve portion is arranged to selectively couple and decouple the liquid passage, the first section liquid line and the second section delivery passage and (ii) the second valve portion is arranged to selectively fluidly couple and decouple the air passage, the first section vent airline and the second section vent passage, such fluid coupling and decoupling being responsive to movement of the actuation member by the user.

26. A method for one of delivering, storing or transporting a liquid organic compound, the method comprising the steps of:

providing a portable container having an enclosure with an interior volume and a fill/delivery nozzle fluidly coupled to interior volume and extending outwardly from the enclosure and a nozzle and vent assembly, wherein the nozzle and vent assembly includes:

a first section that is sealingly and fluidly coupled to the fill/delivery nozzle, the first section including a liquid line through which the liquid from the enclosure flows and a vent airline through which air flows to the interior volume;

a second section that is movably coupled to the first section, the second section including a liquid delivery passage, an air vent passage, the air vent passage being fluidly coupled to atmosphere and a nozzle;

a passageway alignment assembly disposed in the first and second sections, the passageway alignment assembly being configured so as to align the first section liquid line and the second section liquid delivery passage and to align the vent airline and the second section air vent passage responsive to movement of the second section with respect to the first section; and a valve assembly that includes a longitudinal valve member having first and second valve portions, and an actuation member operably coupled to the longitudinal valve member, where the first valve portion and second valve portion are selectively opened and closed responsive to movement of the actuation member.

27. The method of claim 26, wherein for delivering the liquid organic compound, said method further comprises the steps of:

aligning the first section liquid line and the second section delivery passage and the vent airline and the second section vent passage are aligned with respect to each other;

actuating the actuation member so as to move the first and second valve portions into the open position, whereby the first section liquid line and the second section delivery passage are fluidly coupled to each other and the first section vent airline and the second section vent passage are fluidly coupled to each other; and manipulating the container so that the liquid can flow through each of the first section liquid line and the second section delivery passage to a targeted receptacle.

28. A portable container for storing and transporting fuel, the fuel including volatile organic compounds, comprising:

a fuel container portion;

a platform including a platform fuel passage and a platform air channel, the platform fuel passage and the platform air channel being in fluid communication with the fuel container portion;

a nozzle assembly in removable-mechanical communication with the platform, the nozzle assembly including a nozzle, an adjustable nozzle assembly portion, and a nozzle assembly air channel substantially aligned with the platform air channel, wherein the platform is operative to couple the nozzle assembly to an upper portion of a front side of the fuel container portion;

wherein the nozzle is coupled to the adjustable nozzle assembly portion and includes a nozzle fuel channel and a nozzle air channel that each extend along a length of the nozzle and through the adjustable nozzle assembly portion, wherein the adjustable nozzle assembly portion is operative to rotate to a first position to move the nozzle fuel channel into alignment with the platform fuel passage, and to move the nozzle air channel into alignment with the nozzle assembly air channel; and wherein the adjustable nozzle assembly is further operative to rotate to a second position to move the nozzle fuel channel out of alignment with the platform fuel passage, to move the nozzle air channel out of alignment with the nozzle assembly air channel, and, while in the second position, to block and seal the platform fuel passage and the nozzle assembly air channel, thereby substantially preventing escape of the volatile organic compounds from the fuel container portion to the atmosphere through the platform fuel passage and the nozzle assembly air channel.

* * * * *